US005979545A

United States Patent [19]

Pierce

[11] Patent Number: 5,979,545

[45] Date of Patent: Nov. 9, 1999

[54] FACADE PLATE, METHOD OF ASSEMBLY, ASSEMBLED HEAT EXCHANGER AND KITS PART THEREFOR

[76] Inventor: David Bland Pierce, 344 Sutton Road, Walsall, United Kingdom, W35 3BB

[21] Appl. No.: 09/095,664

[22] Filed: Jun. 10, 1998

[30] Foreign Application Priority Data

Jun. 10, 1997 [GB] United Kingdom ..... 9711873

[51] Int. Cl.[6] ..... F28F 9/02

[52] U.S. Cl. ..... 165/158; 165/76; 165/178; 165/134.1; 29/538

[58] Field of Search ..... 165/76, 178, 134.1, 165/158; 29/538

[56] References Cited

U.S. PATENT DOCUMENTS

| | | | |
|---|---|---|---|
| 1,809,910 | 12/1931 | Price | 165/158 |
| 1,955,433 | 11/1934 | Miller | 165/158 |
| 2,180,620 | 1/1939 | Thrush | 165/158 |
| 2,225,615 | 12/1940 | Bay | 165/176 |
| 2,716,428 | 8/1955 | Pennella | 165/176 |
| 2,966,373 | 12/1960 | Yount | 165/176 |
| 3,317,222 | 5/1967 | Maretzo | 165/176 |
| 4,159,035 | 6/1979 | Chartet | 165/173 |
| 4,328,862 | 5/1982 | Gossalter | 165/158 |
| 4,396,059 | 8/1983 | Banner et al. | 165/134.1 |
| 4,564,066 | 1/1986 | Gorman | 165/158 |
| 4,640,348 | 2/1987 | Roberts | 165/158 |
| 4,691,769 | 9/1987 | Flamm et al. | 165/158 |
| 5,474,122 | 12/1995 | Pierce | 165/134.1 |
| 5,823,251 | 10/1998 | Romero | 165/158 |

*Primary Examiner*—Ira S. Lazarus
*Assistant Examiner*—Terrell McKinnon
*Attorney, Agent, or Firm*—Barbara S. Pedersen; Ken J. Pedersen

[57] ABSTRACT

This invention relates to a facade plate, method of assembly, assembled heat exchanger, and kit of parts therefor. The facade plate is adapted for securement to at least part of the tube plate of a heat exchanger, the facade plate having apertures conforming to openings in the said part of the tube plate, the facade plate being of a plastic material. The method of mounting the facade plate to the tube plate includes the steps of {i} securing a locking member within the end of each one of many or all of the heat exchanger tubes; {ii} placing the facade plate against the tube plate with the apertures aligned with respective tube plate openings; {iii} selecting a set of tubular inserts which have a part adapted for engagement with a locking member; {iv} passing a respective tubular insert through all or many of the apertures and into the corresponding tube so that the said part engages the locking member. The kit of parts for the repair or refurbishment of a heat exchanger comprises {i} a set of locking members for securement to respective tubes, {ii} a facade plate as herein defined, and {iii} a set of tubular inserts, each having a part adapted for engagement with a locking member.

11 Claims, 2 Drawing Sheets

FACADE PLATE, METHOD OF ASSEMBLY, ASSEMBLED HEAT EXCHANGER AND KITS PART THEREFOR

FIELD OF THE INVENTION

This invention relates to a facade plate, method of assembly, assembled heat exchanger, and kit of parts therefor, and relates in particular to a facade plate for securement to a tube plate of a heat exchanger, and to an assembled heat exchanger.

BACKGROUND OF THE INVENTION

Often it is necessary to cool a working fluid, and it is known for this purpose to use a heat exchanger. Whilst heat exchangers can be of different sizes, the invention is likely to find its greatest utility for the larger sizes of heat exchanger such as those used in power generation plants, land and marine; such plants use a relatively large volume flow and/or speed flow of a liquid coolant.

Heat exchangers usually comprise one or more metallic tubes (typically between 100 and 9000 tubes) suspended between two tube plates, though it is also known to use U-shaped tubes with each tube connected at opposite ends to a single tube plate. Typically, the coolant flows through the tubes, whilst the working fluid passes around and between these tubes and so gives up latent heat (by way of the tubes) to the coolant flowing within the tubes. Each tube may carry external fins (mechanically coupled to or integral with the respective tube) to increase the available surface area for heat transfer, but often the heat exchanger designer will prefer to use the available space to fit a greater number (array) of unfinned tubes, despite the probable cost increase, particularly if the expected operating conditions increase the likelihood of individual tube failure.

Since the working fluid is typically at a higher pressure than that of the coolant, tube failure will result in leakage of the working fluid into the coolant. It is usually uneconomic to treat the coolant to recover the working fluid, and so until the respective tube (when identified) can be replaced it is traditionally taken out of service (with a reduction in heat exchanger capacity). In the interim, escaping working fluid (e.g. oil at 14 kg/sq.cm) may have been discharged with used coolant (e.g. sea water at 2 kg/sq.cm), leading to possible environmental complaints as well as increased heat exchanger operating costs.

Recognised heat exchanger problems are the thinning of a tube wall, particularly adjacent the tube ends, and the pitting or pock-marking of the tube plate(s) around a tube connection position. These problems frequently arise within the tube, or coolant system, in that the coolant can "attack" both at the ends of a tube ("tube" erosion and/or corrosion), and at the tube plate area surrounding the tube ends ("tube to tube plate" erosion and/or corrosion).

Erosion is a common problem in heat exchangers utilising water as a coolant, usually caused by the velocity of flow of the coolant water, especially adjacent the ends of the tube, and over the first few centimeters inside of the tube where the flow may be turbulent. Corrosion can be caused by chemical constituents in the coolant, especially noted for example when the coolant is sea water, used in a heat exchanger for a ship or for a power station located adjacent a tidal estuary.

Thus, these effects singly or together can cause the "as new" tube and tube plate of FIG. 2 to degenerate to the condition of FIG. 3, leading to tube degeneration or failure and leakage of the working fluid into the coolant.

In addition to the erosion shown in FIG. 3, and particularly if the coolant is sea water, there is often localised pitting of the tube plate around the tube end, caused particularly by chemical attack.

STATEMENT OF THE PRIOR ART

Upon the discovery of tube degeneration, it is known to replace the heat exchanger.

It is also known, and more usual, for a heat exchanger engineer to overhaul the heat exchanger i.e. to re-fit the heat exchanger with new tube plates and tubes. In a modification, only the more seriously damaged of the tubes may be replaced, or these may be taken temporarily out of service as by the use of a "tube plug", pending their subsequent replacement.

It is also known for the engineer to refurbish a tube, to keep it in service, by fitting a tubular insert into some or all of the heat exchanger tubes. Tubular inserts typically comprise a tubular section with an outer diameter slightly smaller than the internal diameter of the heat exchanger tube, and with an outwardly extending flange at one end. For the many applications in which sea water is the coolant, the tubular section will normally have a length of approximately five times the nominal bore diameter of the tube, since it has been determined that eddy currents are present in the sea water for approximately this length inside the tube.

The tubular section of the insert is thus intended to protect the inside of the heat exchanger tube from further erosion as well as corrosion, whilst the flange covers and so is intended to help protect the area of the tube plate surrounding the end of the tube, as against pitting. The tubular insert is secured in position as by an applied adhesive, or by the use of an expanding tool to cold-work (stretch) the wall of the (metallic) tubular insert, so increasing its outer diameter into mechanical adhesion with the inner surface of the tube.

A facade plate to cover the tube plate, with apertures aligned with the tube openings in the tube plate, and which can provide a covering surface for the tube plate is disclosed in my application WO94/03767. Also disclosed therein is the use of tubular inserts in combination with the facade plate, to reduce or avoid further erosion and/or corrosion of the tubes.

DISCLOSURE OF THE INVENTION

In order to reduce or overcome the erosion and/or corrosion problems as described, and so as to inhibit leakage of working fluid into the coolant, we now propose a facade plate and assembly having greater utility that that disclosed in my previous application, and in particular offering ease of fitment by one man working alone. The facade plate and assembly as described herein will increase the number of applications in which facade plates may be used, so leading to a reduction in the instances of, and/or the duration of, leaking working fluid.

Notwithstanding the suitability of the facade plate as herein defined for many heat exchanger applications, I foresee its use mainly where the coolant is water, perhaps sea water, since it is in such uses that erosion of the tube and tube plate most usually occurs.

Accordingly, we disclose a facade plate for securement to at least a part of the tube plate of a heat exchanger, the facade plate having apertures conforming to the openings in the said part of the tube plate, the facade plate being of a plastic material.

The facade plate is preferably of nylon 11, which is resistant to attack by water, and also by sea water.

Because the facade plate is of plastic material it is lightweight in comparison to prior facade plates. For some ship and power station heat exchangers, the facade plate can be several feet across; a metallic facade plate of such a size is particularly heavy, but a facade plate according to the invention, even of such a large size, can be carried and manipulated by one man, so making the job of fitting the facade plate far simpler and quicker. If a facade plate is to be fitted to the heat exchanger of a ship for example, the ease and speed of fitment is of great importance, since the cost of keeping the ship out of service, even for a short period of time, is considerable. In addition, prior to use the facade plate can usually be wound into a roll, so facilitating ease of carrying and transportation. A wound facade plate can be stored in a tubular container, reducing the likelihood of damage during transportation.

In addition, the cost of manufacture of the facade plate according to this invention is far lower than the metallic designs, since providing the apertures in the plastic facade plate is far easier than for a metal facade plate.

Desirably, the facade plate has a sealing sheet affixed thereto, the sealing sheet having apertures corresponding to the apertures of the facade plate. In use, the sealing sheet will be located between the facade plate and the tube plate. Preferably, the sealing sheet is resiliently compressible, and is in a partially-compressed state in the fitted condition.

We also disclose a method of mounting a facade plate as herein defined to a tube plate of a heat exchanger including the steps of {i} securing locking members within the end of many or all of the heat exchanger tubes; {ii} placing a facade plate against the tube plate with the apertures aligned with respective tube plate openings; {iii} selecting a set of tubular inserts which have a part adapted for engagement with a locking member; {iv} passing a tubular insert through all or many of the apertures and into the corresponding tube so that the said part engages the locking member.

Preferably, the part of the tubular insert adapted for engagement with the locking member is an outwardly projecting finger or plurality of fingers, the finger(s) having a locking edge. Usefully, the fingers are tapered and the fingers and/or the tubular insert is resilient, so that the fingers are depressed as they are pushed past the locking member and spring back out as they pass this; accordingly, the tubular inserts are a "snap-fit" connection with the locking member, and so with the heat exchanger tube. In such an embodiment, a fitter can support the facade plate with one hand and insert a tubular insert into a chosen aperture with the other hand, the tubular insert once fitted being retained in position (and so retaining the facade plate in position) by virtue of the engagement between the locking edge and the locking member. Subsequent tubular inserts can similarly be fitted, until an insert has been fitted to all of the tubes (or all of the chosen tubes if for any reason not all of the tubes are to have inserts fitted thereinto).

The flange of the tubular insert can be cupped, to locate a sealing member, the sealing member in use sealing the tubular insert against the facade plate. Preferably, flange is heat welded to the facade plate to provide a continuous seal therebetween.

Preferably the tubular inserts are of a hygroscopic material, which in use expands in the presence of water. Preferably also the facade plate is of hygroscopic material.

The tubular inserts act both to retain the facade plate against the tube plate, i.e. they act as holding members, and also to protect the inside of the tubes from further erosion and/or corrosion.

Preferably the facade plate is replaceable with another of the same design, so that if in use it (or any of the fitted tubular inserts) is affected by erosion and/or corrosion (as is "intended" i.e. in preference to the tube plate and/or tubes being affected) the facade plate can be removed and replaced, typically without need to replace either the tube plate or tubes.

According to another feature of the invention therefore, there is provided a kit of parts for the repair or refurbishment of a heat exchanger, the kit comprising a set of locking members, a facade plate as herein defined, and a set of tubular inserts each having a part adapted for engagement with a locking member.

The kit can also comprise locking means for the locking members, the locking means comprising an expanding tool to effect the mechanical expansion of a locking member into contact with a tube, or adhesive if it is desired to secure the locking members by this means.

Preferably, the locking member is a ring.

There is also disclosed a heat exchanger having a facade plate mounted thereto by the method as herein defined.

SHORT DESCRIPTION OF THE DRAWINGS

The invention will be further described, by way of example, with reference to the accompanying drawings, in which.

DESCRIPTION OF EXEMPLARY EMBODIMENTS

Figure 1:
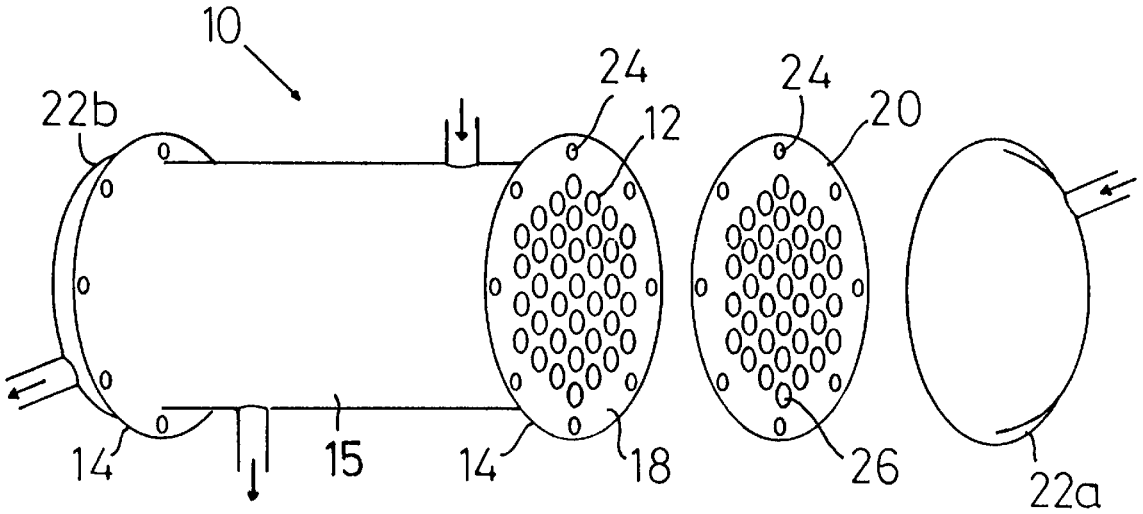
FIG. 1 is a partially exploded view of a heat exchanger with a facade plate according to the invention.

In the drawings, FIG. 1 shows a typical heat exchanger 10, with an array of tubes 12 located between a pair of tube plates 14 and located in a casing 15. The tubes 12 terminate at the tube plates 14, and are secured thereto in known fashion. The open ends 17 of the tubes provide openings in the tube plates 14. The tubes 12 project from the second surface 16 (FIG. 2) of each respective tube plate and are substantially flush with the first surface 18.

In this embodiment, sea water acting as a coolant is supplied through header 22*a* and exits through header 22*b*; the headers 22*a*,22*b* in an alternative embodiment can have one or more baffle plates, and in another embodiment the tubes are U-shaped and with only a single header, in each case so that the coolant returns to header 22*a* before passing out from the header to exhaust.

Figure 2:
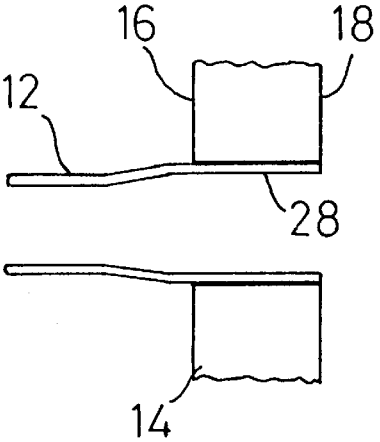
FIG. 2 is a partial view of a single heat exchanger tube, and tube plate, in the "as new" condition.

FIG. 2 shows part of a single heat exchanger tube 12 mounted in the tube plate 14. The tube is manufactured with an outer diameter slightly less that the diameter of the holes of the tube plate (the difference between the diameters is exaggerated in the drawings), and so after being slid into position in the tube plate, an expander tool (not shown) is used to expand the wall of tube 12 at the end 28, to secure the tube 12 to the tube plate 14 and to form a fluid tight seal therebetween, in known fashion.

Figure 3:
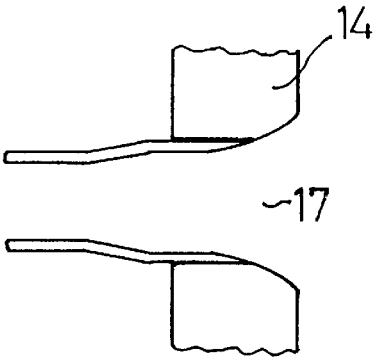
FIG. 3 is a view as FIG. 2 but in an eroded condition.

In use, the rapid and turbulent flow of the coolant fluid adjacent, and within, the end 28 of the tube 12, can cause erosion of the tube and of the tube plate. As explained above, particularly in the case of sea water coolant, this erosion may be combined with corrosion caused by constituents of, or contaminants in, the sea water. The tube, and tube plate, can therefore degenerate in time into a condition such as that illustrated in FIG. 3, increasing the likelihood of either the fluid to be cooled, or of the coolant, passing between the tube and the tube plate, so {a} contaminating, or {b} causing leakage of, the fluid to be cooled. It will be understood that whilst erosion as by turbulence is greatest within the tubes 12 at the (entrance) end where the coolant enters the tubes, the (exit) end at which the fluid discharges can also become eroded.

The facade plate 20 is, in use, pressed against the first surface 18 of the tube plate 14 and so is sandwiched between the tube plate 14 and the header 22*a*. In a preferred embodiment a second facade plate is pressed against the opposed (outer) surface of the other tube plate and so is sandwiched between that opposed surface and the header 22*b*.

The facade plate 20 is secured at its outer periphery by bolts (not shown) passing through holes 24 in the tube plate 14 and facade 20, and into header 22*a*.

The facade plate 20 has pre-formed apertures 26, the apertures 26 being of a number and in position to correspond with the openings in the tube plate 14 and thus with the tubes 12. As better seen in FIG. 4, the size of apertures 26 is chosen to be slightly larger than the inner diameter of the expanded ends 28 of the tubes 12, though in an alternative embodiment the diameters may be identical.

Figure 4:
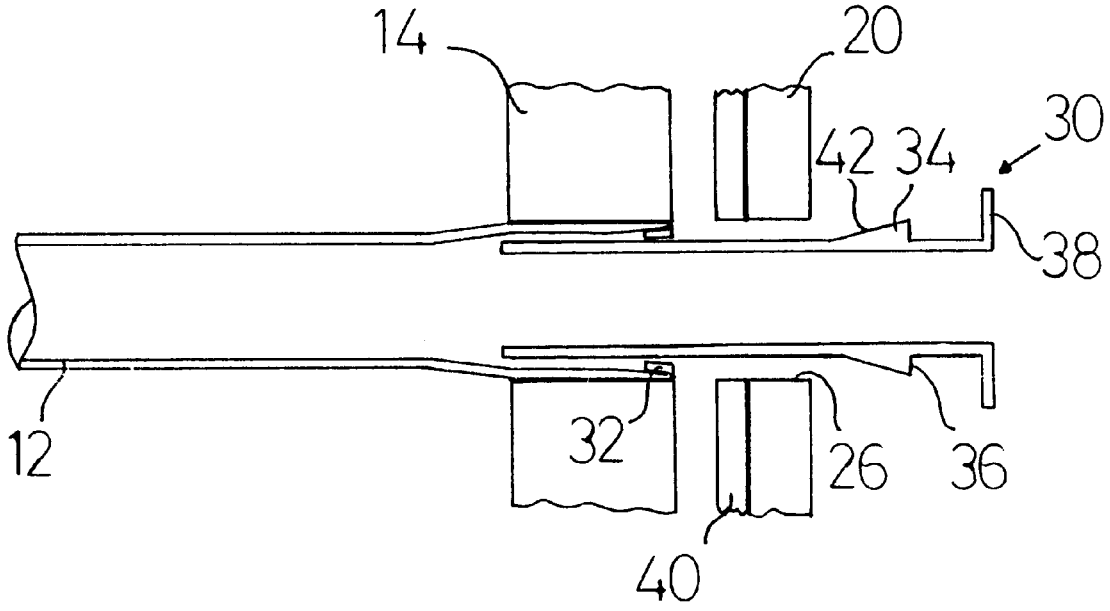
FIG. 4 is a part-sectional view of the tube plate and facade plate of FIG. 1, with a tubular insert being fitted thereto.
Figure 5:
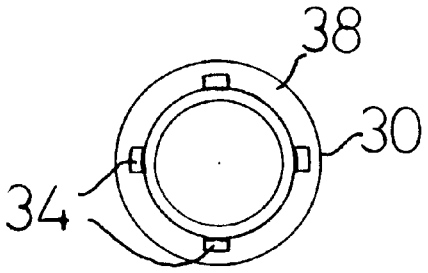
FIG. 5 is an end view of the tubular insert of FIG. 4.

FIG. 4 also shows a tubular insert 30 to be passed through each aperture 26, or each chosen aperture 26. The tubular insert 30 has a dual function. Firstly, it prevents or reduces erosion and/or corrosion of the facade plate 20 adjacent the apertures 26, as well as further erosion and/or corrosion of the end of the tube 12. It achieves this function by preventing or reducing the likelihood of the coolant fluid coming into "fast-flow" contact with the ends 28 of the heat exchanger tubes 12 and the area of the facade plate surrounding the apertures 26, and for this reason is of a length usefully in the range of four to six times the inner nominal diameter of the tube 12, and preferably approximately five times the inner nominal diameter.

The second function of the tubular insert is that of a holding member, i.e. it acts to retain the facade plate in position relative to the tube plate, as hereinafter described.

As an initial step to fit the facade plate to an in-service heat exchanger, an extreme end portion of each tube 12 is cleaned to remove any dirt or debris adhering thereto.

Thereafter, a locking member, in this embodiment a ring 32, is secured to the end of each of the tubes 12. Preferably, the locking ring is of metal, suitably that known as Royal Naval brass, and is secured by being mechanically expanded into engagement with the eroded and corroded end of the tube.

It would be possible to fit a metallic or non-metallic locking ring by means other than mechanical expansion, for example by way of adhesive, of by way of a force fit into the end of the tube. However, mechanical expansion of a metallic locking ring is preferred at this is likely to provide a more secure ring. In addition, the incorrect use of adhesive may result in excess adhesive fouling the facade plate, and the forcing of a locking ring into the tube end may only be practical with a new (i.e. uneroded or corroded) tube.

The tubular insert 30 has a number of (in this embodiment, four) outwardly projecting fingers 34, which have a locking edge 36 which is engageable behind (i.e. to the left of in the orientation of FIG. 4) the locking ring 32 in the fully inserted condition.

The tubular insert also has a flange 38 which has an outer diameter larger than that of the facade plate apertures. Thus, the flange 38 engages the facade plate adjacent the aperture 26. In another embodiment the flange is cupped so that only its outer periphery engages the facade plate; alternatively, the cupped flange may carry a sealing ring engageable with the facade plate.

In an alternative embodiment, the fingers 34 are replaced by an integral ring, whilst the locking ring 32 is replaced by angularly spaced inwardly projecting locking fingers. In another alternative, the tubular insert has a number of fingers engageable with a number of locking fingers secured to the tube.

Between the facade plate 20 and the tube plate face 18 is a non-porous sealing sheet 40, which in this embodiment is cut to form a perforated sheet of rubberised material. In this embodiment the sealing sheet is fixed to the facade plate 14 during its manufacture, to facilitate ease of fitment; however, in other embodiments the sealing sheet is not fixed to but is in abutment with the facade plate. In use, the sealing sheet 40 acts to prevent any coolant that encroaches between the facade plate 20 and the tube plate 14 from contacting all but a small area of the region between the plates.

When inserting the tubular insert 30 into the tube 12, the flange 38 of the insert first engages the facade plate 20 so that further insertion of the tubular insert 30 into the tube 12 to the locking position urges and then holds the facade plate and sealing sheet against the tube plate.

The fingers 34, and/or the tubular insert 30, are resiliently deformable, so that they can be forced past the locking ring 32, the tapered leading edge 42 assisting this procedure. As the fingers pass the locking ring, the resilience causes them to spring outwards so that the locking edge 36 is retained by the locking ring 32.

The sealing sheet 40 is compressible, and it is arranged that the sealing sheet 40 must be compressed slightly in order for the fingers 34 to pass the locking ring 32. Also, it is arranged that the sealing sheet 40 retains some compression when the locking edges 36 of the fingers are retained by the locking ring 32, so that the fingers 34 and locking ring 32 are maintained in secure contact. The remaining compression of the sealing sheet 40 adjacent each tubular insert will also increase the effectiveness of the seal between the facade plate and the tube plate, reducing the likelihood of coolant or working fluid passing between the plates.

To fit the facade plate 20 (following fitment of the locking rings 32) the facade plate is placed alongside the tube plate 14, and the apertures 26 are aligned with the corresponding heat exchanger tubes 12. A tubular insert 30 is then passed through a chosen aperture 26 and into the corresponding tube 12, and pushed into the tube sufficiently to engage the locking edge 36 of the fingers 34 with the locking ring 32. Another tubular insert is similarly fitted to another chosen aperture until all of the (chosen) apertures 26 have been utilised. In another embodiment, particularly for unused heat exchangers which are to be fitted with a facade plate during their manufacture, the inserts can be fitted simultaneously; in addition, the locking rings can also be fitted simultaneously.

To provide additional security against coolant leakage between the facade plate and tubular insert, the tubular insert can be of plastics material and its flange 38 can subsequently be heat welded to the facade plate.

It would be possible initially to align only a single aperture with its corresponding opening prior to fitment of the first tubular insert. However, adopting such a procedure might result in the tubular insert being pushed into the wrong opening; the time taken subsequently to remove the tubular insert rendering such a procedure unlikely in practice.

The low weight of the facade plate, and the "snap-fit" action of the tubular inserts, enables the mounting of the facade plate to be carried out by one man, even for the largest of heat exchangers. It will be understood that the largest heat exchangers, particularly those with tube plates of around 2 metres square or above, could utilise several facade plates, the respective facade plates being fitted separately to a different section of the tube plate and preferably with their side edges abutting—with perhaps intervening seals or sealant between the abutting side edges.

Whilst the facade plate would provide an extended life to an already eroded and/or corroded tube plate and tube, it is foreseen that many users of heat exchangers would require the fitment of a facade plate to new heat exchangers. Since, in use, the facade plate is not subjected to the pressures of the fluid to be cooled and for which pressures the tube plate is designed, the facade plate does not itself need to be thick enough to withstand the pressures of the working fluid. Nor is the facade plate subjected directly to the high temperature of the working fluid.

It is envisaged that for a ship's heat exchanger utilising tubes of a nominal diameter of 19.05 mm (¾ inch), the facade plate would be of 6 mm thick nylon 11 material. Ideally, the facade plate should be substantially incompressible. The sealing sheet could be between 2 mm and 5 mm thick, and the locking ring could be 1 mm thick (in the direction of the tube diameter) and 2 mm long (in the direction of the longitudinal axis of the tube). All of the above dimensions are approximate. An additional advantage of a facade plate of 6 mm thick nylon 11 is that it can be wound into a roll and so be supplied in a rolled condition, perhaps in a tubular container which also contains the locking rings and tubular inserts.

For applications in which the medium flowing through the tubes is water, another advantage of using nylon 11 is that this material is hygroscopic, i.e. it absorbs water and so expands slightly in use. Accordingly, the facade plate will expand slightly in use to further compress the sealing sheet and so increase the seal provided thereby. In addition, if the tubular inserts are also of a hygroscopic material, they will expand slightly in use and increase the seal between the insert and the tube wall, and also increase the engagement between the locking fingers and the locking ring.

If the facade plate of the invention is to be fitted to a new heat exchanger, the tube plate, which needs to be of thick section (i.e. between the first 18, and second 16, surfaces) to withstand the differential pressures involved, could be manufactured from a material of lesser corrosion and/or erosion resistance, so saving on cost, the facade plate and tubular inserts being provided for corrosion and erosion resistance. In addition, notwithstanding that the facade plate is secured by the tubular inserts 30, it will nevertheless be removable (albeit by perhaps damaging the tubular inserts and/or the facade plate), and so could be replaceable by another facade plate, if the original facade plate becomes eroded or corroded during its use.

Whilst the facade plate 20 has peripheral holes 24 to receive header bolts, these are not always required, i.e. the facade plate may not extend fully across the tube plate but terminate short of the edge thereof; in such embodiments, the facade plate would be held in place only by the tubular inserts.

We have thus provided a further embodiment of facade plate which can provide a solution to the problems of damaged or likely to be damaged heat exchangers, at a cost which we believe will be substantially less than the previously available methods. Thus the host, such as a cargo ship or cruise liner, may spend a minimum non-revenue earning time e.g. in dock, awaiting repair of the heat exchanger (perhaps also with the extra cost and delay of specialists brought in to assist the (ship's) engineers. The facade plate according to this invention will, it is believed, greatly increase the use of facade plates for this purpose, will reduce the cost of facade plates, and will greatly increase the ease and speed with which they may be fitted.

I claim:

1. A facade plate for securement to at least part of a tube plate of a heat exchanger, the facade plate having apertures conforming to openings in the said part of the tube plate, the facade plate being of a hygroscopic plastic material.

2. A facade plate according to claim 1 in which the facade plate is of nylon.

3. A facade plate according to claim 1 in which the facade plate has a sealing sheet affixed thereto, the sealing sheet having apertures corresponding to the apertures of the facade plate.

4. A facade plate according to claim 3 in which the sealing sheet is resiliently compressible.

5. A method of mounting a facade plate to the tube plate of a heat exchanger, the tube plate having openings defined by the tubes fitted thereto, the facade plate having apertures conforming to the openings, the facade plate being of a plastic material, the method including the steps of {i} securing a locking member within the end of each one of many or all of the heat exchanger tubes;

{ii} placing the facade plate against the tube plate with the apertures aligned with respective tube plate openings;

{iii} selecting a set of tubular inserts which have a part adapted for engagement with a locking member;

{iv} passing a respective tubular insert through all or many of the apertures and into the corresponding tube so that the said part engages the locking member.

6. A method according to claim 5 in which the tubular insert is also of plastics material, and the method includes the additional step of heat welding a part of the tubular insert to the facade plate.

7. A heat exchanger having a facade plate mounted thereto by the method according to claim 5.

8. A kit of parts for the repair or refurbishment of a heat exchanger by way of the fitment of a facade plate to the tube plate of the heat exchanger, the tube plate having openings defined by the tubes fitted thereto, the kit comprising {i} a set of locking members for securement to respective tubes, {ii} a facade plate having apertures conforming to the openings, the facade plate being of a plastic material, and {iii} a set of tubular inserts, each having a part adapted for engagement with a locking member.

9. A kit of parts according to claim 8 in which the part of the tubular insert adapted for engagement with the locking member is at least one outwardly projecting finger, the finger having a locking edge providing the said part adapted for engagement with a locking member.

10. A kit of parts according to claim 7 in which the finger(s) of the tubular insert is/are tapered.

11. A kit of parts according to claim 8 in which the locking member is a metallic ring.

* * * * *